US011738905B2

(12) United States Patent
Pacia et al.

(10) Patent No.: US 11,738,905 B2
(45) Date of Patent: Aug. 29, 2023

(54) COMBINED PRODUCE BASKET AND SLEEVE

(71) Applicant: A.J. TRUCCO, INC., The Bronx, NY (US)

(72) Inventors: Nicola Pacia, The Bronx, NY (US); Thomas Latzkowski, The Bronx, NY (US)

( * ) Notice: Subject to any disclaimer, the term of this patent is extended or adjusted under 35 U.S.C. 154(b) by 0 days.

(21) Appl. No.: 17/308,656

(22) Filed: May 5, 2021

(65) Prior Publication Data

US 2022/0055792 A1 Feb. 24, 2022

Related U.S. Application Data

(60) Provisional application No. 63/020,529, filed on May 5, 2020.

(51) Int. Cl.

| | |
|---|---|
| ***B65D 5/38*** | (2006.01) |
| ***B65D 85/34*** | (2006.01) |
| ***B65D 5/468*** | (2006.01) |
| ***B65D 5/42*** | (2006.01) |

(52) U.S. Cl.

CPC ..... *B65D 5/38* (2013.01); *B65D 5/4208* (2013.01); *B65D 5/4608* (2013.01); *B65D 85/34* (2013.01)

(58) Field of Classification Search

CPC ..... B65D 5/38; B65D 5/4208; B65D 5/4608

USPC ..... 229/125.125, 125.12–125.25, 106–114, 229/117.9, 117.12, 117.14

See application file for complete search history.

(56) References Cited

U.S. PATENT DOCUMENTS

| | | | | |
|---|---|---|---|---|
| 312,421 A * | 2/1885 | Bauer | B65D 5/48038 206/521.1 |
| 3,141,599 A * | 7/1964 | Hasselhoff | B65D 5/38 229/117.22 |
| 2018/0118405 A1* | 5/2018 | Walling | B65D 5/443 |

FOREIGN PATENT DOCUMENTS

| | | | |
|---|---|---|---|
| CH | 699537 B1 * | 3/2010 | B65D 5/2009 |
| EP | 2143649 A1 * | 1/2010 | B65D 5/321 |
| FR | 2710321 A1 * | 3/1995 | B65D 5/2033 |

* cited by examiner

*Primary Examiner* — Nathan J Newhouse
*Assistant Examiner* — Phillip D Schmidt
(74) *Attorney, Agent, or Firm* — Cittone Demers & Arneri LLP; Henry J. Cittone

(57) ABSTRACT

An easy to assemble and store, recyclable assembly of a produce basket with a complementary carrying sleeve, assembled from pre-formed flat components that fold into shape is disclosed.

2 Claims, 20 Drawing Sheets

COMBINED PRODUCE BASKET AND SLEEVE

CROSS-REFERENCE TO RELATED APPLICATIONS

This application claims priority to U.S. Provisional Patent Application No. 63/020,529 filed May 5, 2020 the disclosure of which is incorporated herein by reference.

BACKGROUND

Numerous plastic-based solutions to enable and encourage the purchase of pre-weighed quantities of fruit exist. These include plastic bags with handles and plastic clamshell type packaging solutions. These solutions provide for increased sales and ease of buying or fruit. However, they fail to provide for easily recyclable waste. In fact it is estimated that some 90% of plastic packaging is not recycled, despite being collected for recycling. Much of it is landfilled or burnt for energy production.

What is needed in the fruit packaging industry is an easy to recycle container product that is also (i) easy to assemble, (ii) easy to pack with fruit, (iii) retains its shape and ability to contain produce through the point of final consumption and (iv) provides sufficient ventilation to preserve the produce.

SUMMARY OF THE INVENTION

In aspects of the present invention a cellulosic or plant-sourced fiber forms a combination basket and carrying sleeve. The basket and carrying sleeve are easily assembled from pre-formed flat components that fold into shape. The basket may allow for ease of automated and manual fruit packing by having dimensions sufficient to allow human hands or machine components to fill it. The basket and carrying sleeve may function together to maintain structural shape and rigidity during transport and shipping. The basket and carrying sleeve may be fitted with vent holes to provide air flow to the produce to reduce the chance of spoilage during transport, distribution and display at a point of sale.

In further aspects the fiber materials chosen for the basket and sleeve are chosen from those typically recycled in the region of use.

In further aspects structural rigidity of the basket is enhanced by having an irregular octagonal shape. In further aspects the irregular octagonal shape has sloping sides.

In still further aspects the sleeve has a carrying handle, which may be integral to the sleeve.

The various features of novelty which characterize the present invention are pointed out with particularity in the claims annexed to and forming a part of this disclosure. For a better understanding of the present invention, its operation, advantages and specific objects attained by its use, reference should be had to the accompanying drawings and descriptive matter in which preferred embodiments of the invention are illustrated and described.

DETAILED DESCRIPTION

The present invention is directed, inter alia, to provision of a combination basket and sleeve for storing produce. When used with produce the basket sleeve combination provides an easy to recycle container product that is easy to assemble, easy to pack with fruit, retains its shape and ability to contain produce through the point of final consumption and provides sufficient ventilation to preserve the produce.

A central feature of the invention is the provision of a produce package that is sturdy and recyclable while using a minimal amount of recyclable fiber-based material. For example, the material is ideally a paperboard material.

Figure 1:
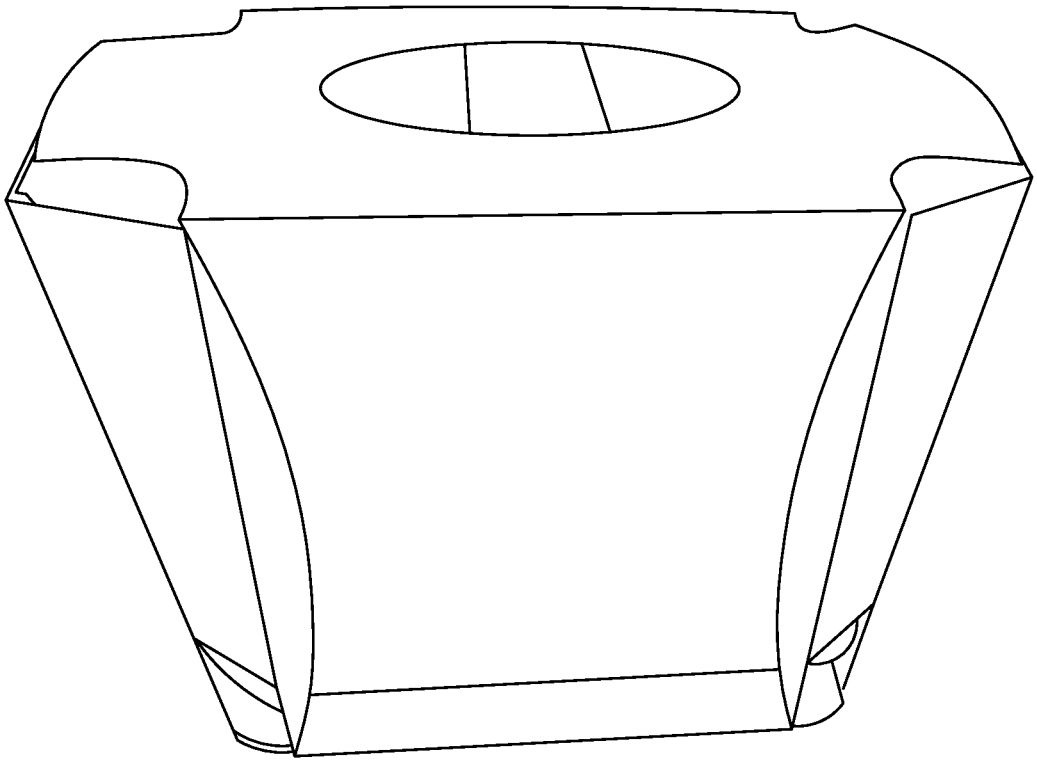
FIG. 1 shows an embodiment of the basket and carrying sleeve assembly according to the present invention.

By way of overview, in an embodiment of the present invention, depicted in FIG. 1 the basket and carrying sleeve assembly/combination forms an irregular octagonal shape with sloping sides and ventilation holes formed from a flat paperboard folded into shape and having end flaps affixed with glue which forms a basket to hold produce. A sleeve capable of being slid over the basket and having a handle or grip is formed from paper board, ideally thinner paperboard to reduce waste.

While the preferred embodiments of the invention are illustrated and described herein, it will be clear that the invention is not limited to these embodiments only. Numerous modifications, changes variations, substitutions and equivalents will be apparent to those skilled in the art, without departing from the spirit and scope of the invention, as described in the claims.

Selected embodiments of the present invention are now explained with reference to the drawings. It will be apparent to those skilled in the art from this disclosure that the following description of the embodiments of the present invention is provided for illustration purposes only, and not for the purpose of limiting the invention, as defined by the appended claims.

Referring now to the Figures, in embodiments of the present invention as shown in FIG. 1 a combination/assembly of basket, 100, and sleeve 200 are provided suitable to contain and carry produce.

In a preferred embodiment the basket 100 is made of paperboard with a water repellent inner coating.

Figure 2:
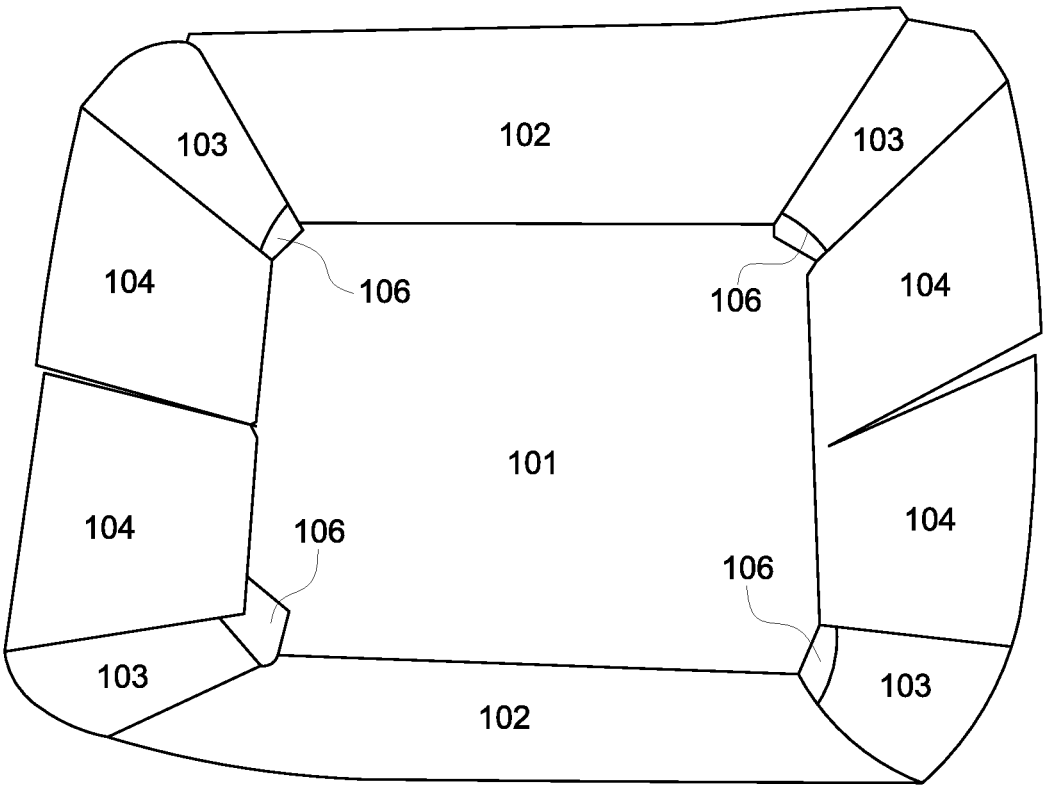
FIG. 2 is a top view of the assembled basket according to an embodiment of the present invention.

Referring now FIG. 2, according to an embodiment the basket 100 may be rectangular in shape, but is preferably an irregular octagonal, having a bottom 101, two long sides 102, each long side having two vertical support members 103 formed as a twice bent flap, with the paper board at the farther bend forming a short end flap 104. This yields a total of four vertical support members 103 and four short end flaps 104. The short end flaps 104 are adhered to the two end flaps 105(two per end flaps 105) which are formed from a bend in the paperboard at the short edge of the bottom 101.

Figure 3:
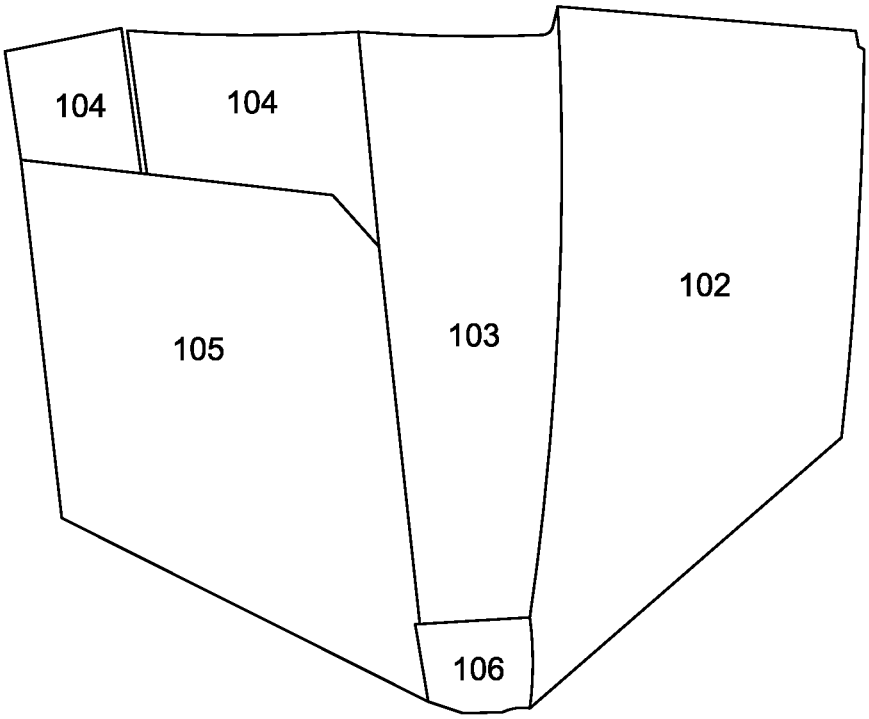
FIG. 3 is a perspective view of the assembled basket according to an embodiment of the present invention.

The vertical support members 103 are trapezoidal having a longer end at the top of the basket and are shortened at their lower end to form vent hole 106, as show in FIG. 3, which also serves to allow for drainage in the event a produce item spoils or is crushed or damaged.

Figure 4:
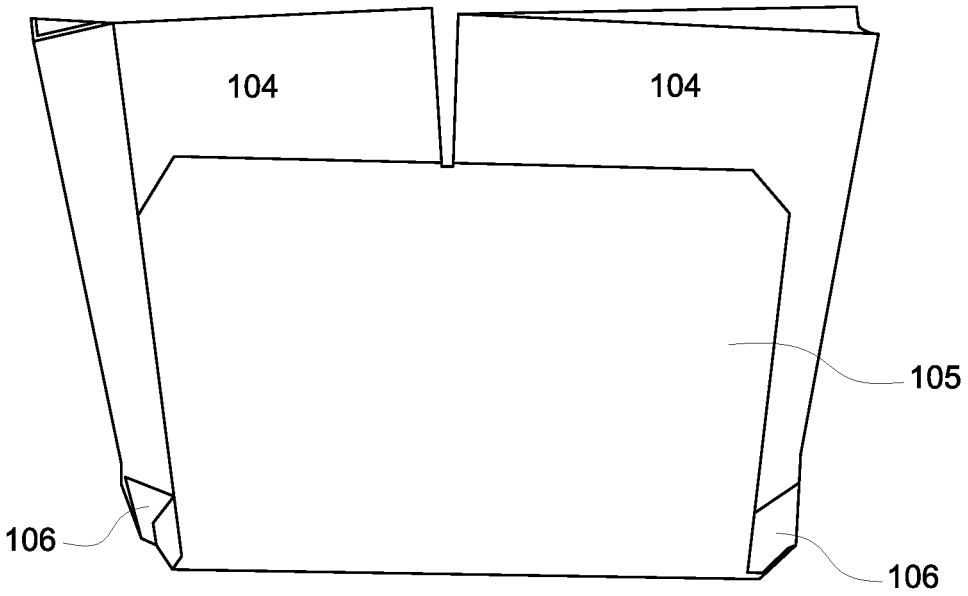
FIG. 4 is a side view of the of the assembled basket according to an embodiment of the present invention.
Figure 5:
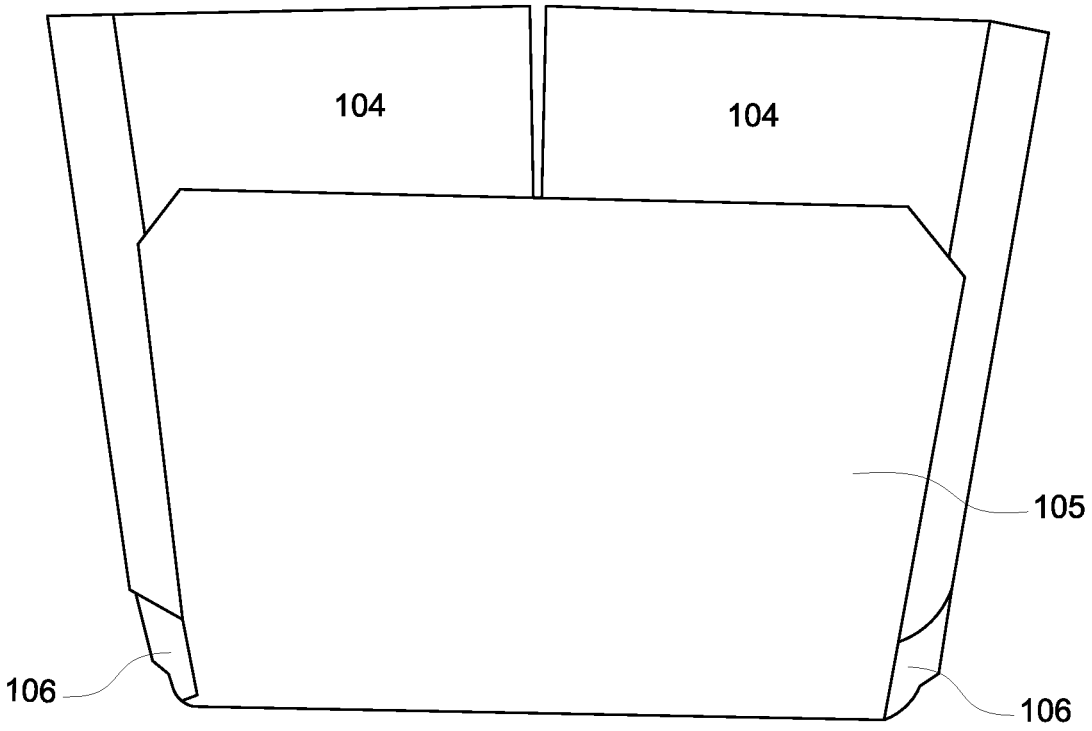
FIG. 5 depicts the opposite side view of the view depicted in FIG. 4.

End flaps 105 are preferably rectangular as are short end flaps 104, as shown in FIGS. 4 and 5.

Figure 6:
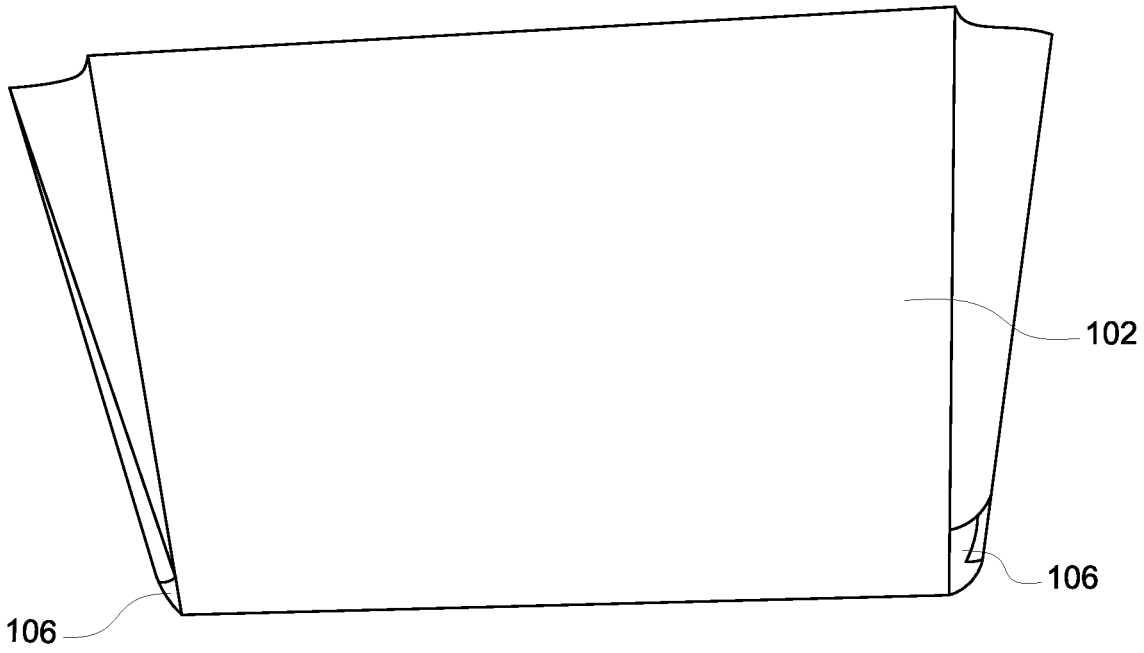
FIG. 6 shows a side view of a different side of the assembled basket depicted in FIG. 3.
Figure 7:
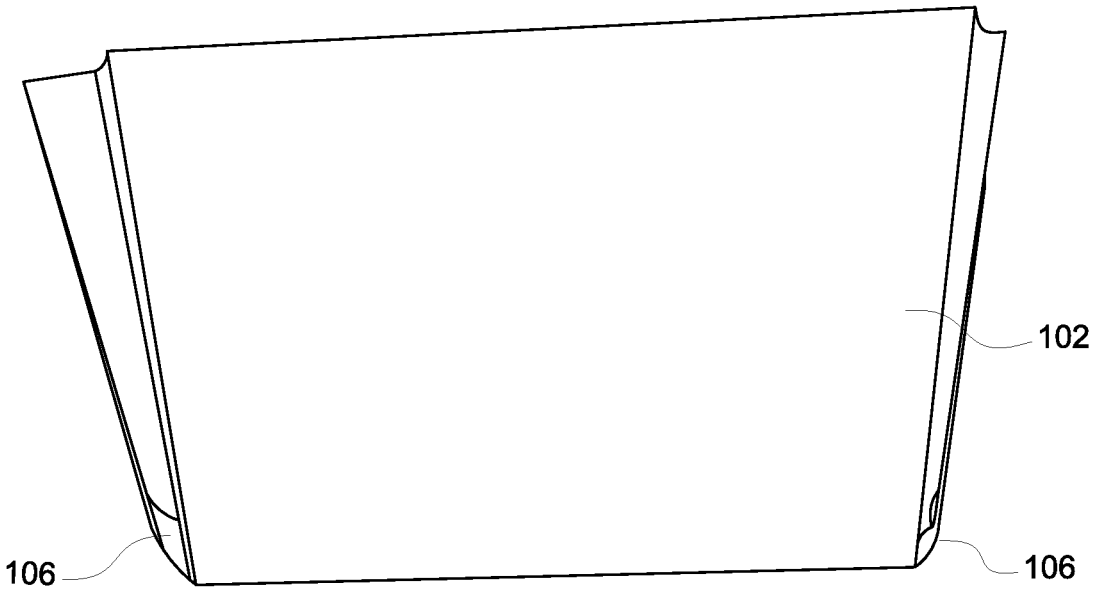
FIG. 7 is a side view of the basket according to an embodiment of the present invention showing the side opposite to the one depicted in FIG. 6.

As depicted in FIGS. 6 and 7 the long sides 102 are preferably higher than the four vertical support members 103, four short end flaps 104 and two end flaps 105 to create headspace for ventilation across the full length of the six shorter edges of the basket.

Figure 8:
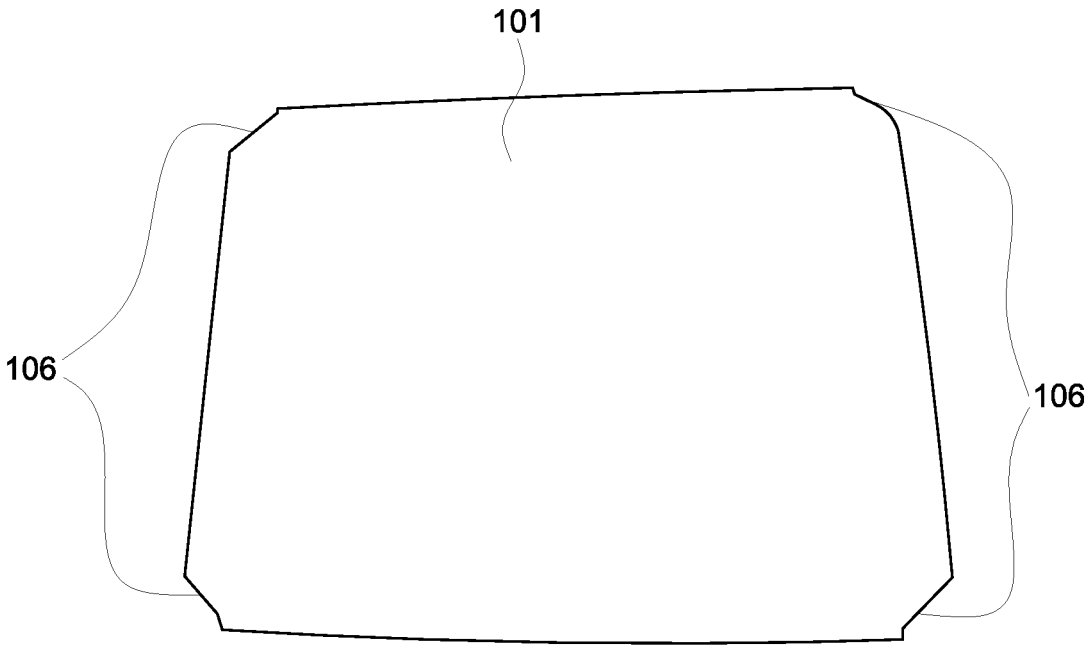
FIG. 8 is a bottom view of the assembled basket according to an embodiment of the present invention.

The bottom of the basket also has a rectangular-like shape with a vent whole formed at each corer as depicted in FIG. 8.

Figure 9:
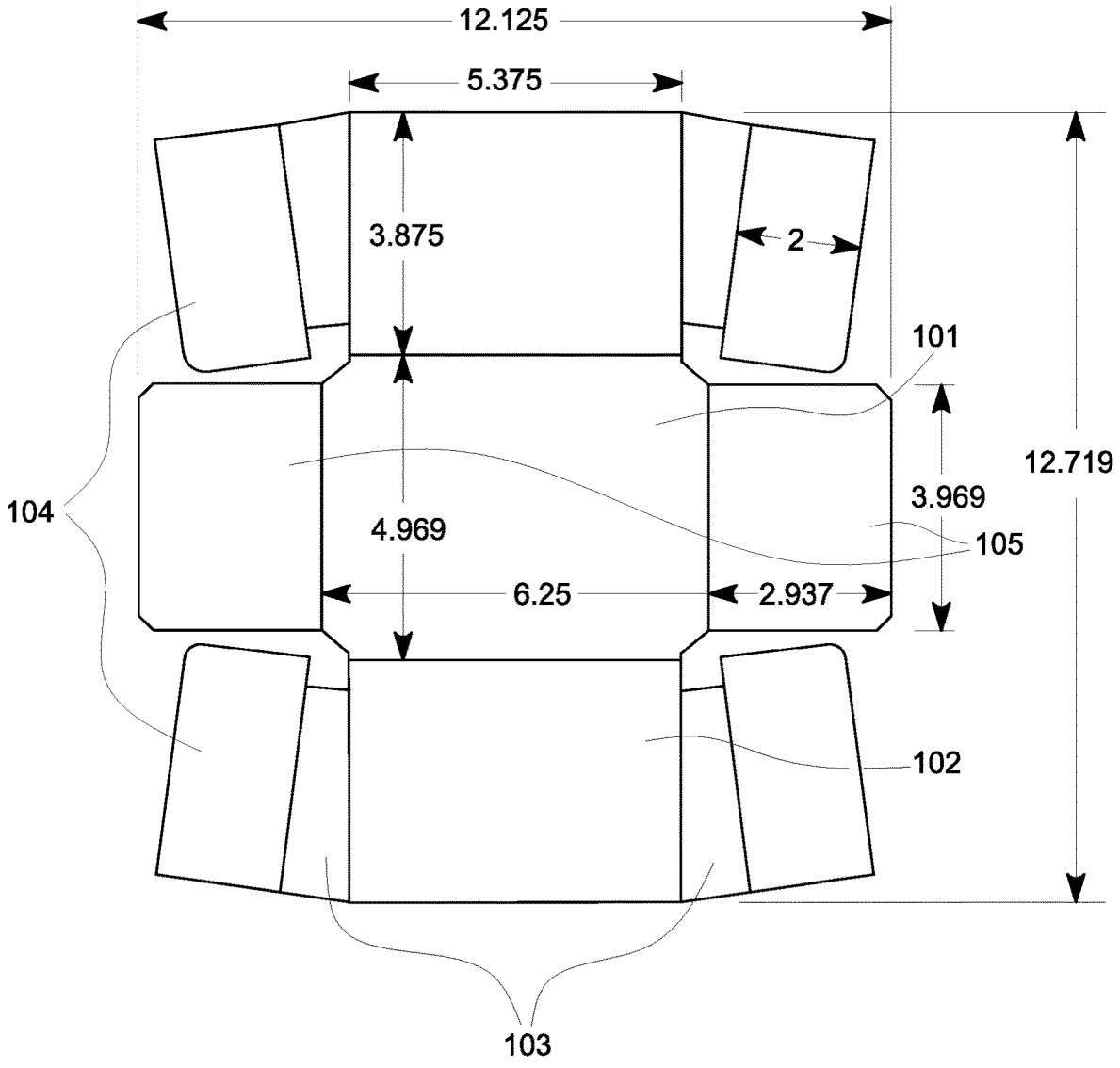
FIG. 9 depicts an unassembled basket according to an embodiment of the present invention, showing where cuts and perforations are made for folding.

FIG. 9 depicts an unassembled basket (in the form of a pre-cut sheet) according to an embodiment of the present invention with the cuts and perforations necessary for folding shown.

Figure 10:
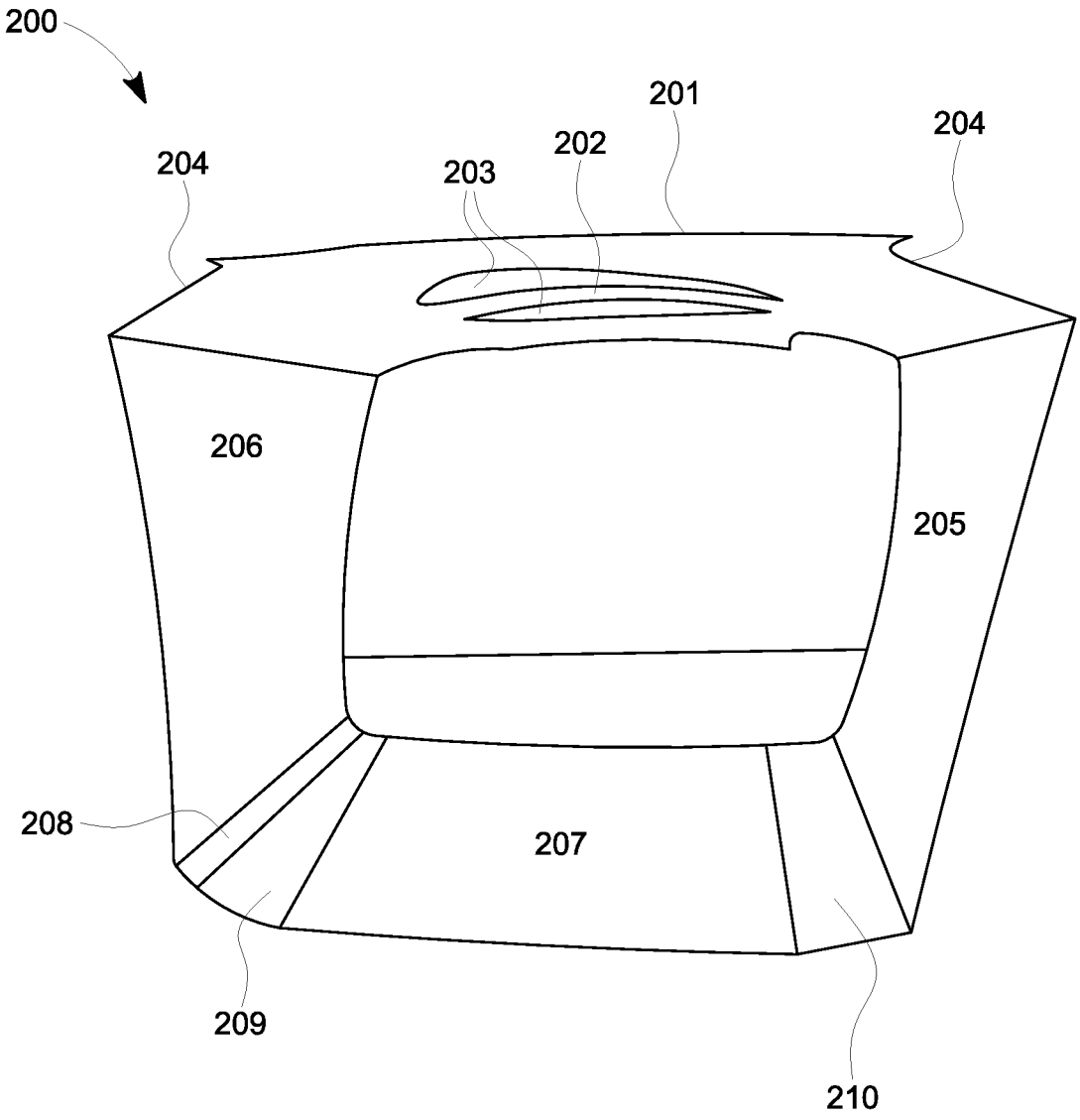
FIG. 10 is a perspective side view of the assembled carrying sleeve according to an embodiment of the present invention.

And in a preferred embodiment, as shown in FIG. 10, the sleeve 200 is made of paperboard with sufficient strength to allow carrying via the integral handle 201.

Now referring to the sleeve 200, it is at least four sided, but is preferably seven-sided to provide sufficient support to the basket when it is deformed by the weight of the produce and to provide the sleeve with sufficient strength to not tear due to the load of the produce. The sleeve has a sleeve top 201 having an integral handle 202 disposed in the approximate center of the sleeve top 201. The sleeve top 201 preferably has vent holes 203 located on either side of the integral handle 202 and four corner vents 204 at the corners. The corner vents 204 are scooped in shape to increase the vent area along the top of the short end of the basket. The sleeve side walls 205 and 206 are curved to provide strength while reducing paperboard used. The sleeve bottom 207 has on one end a trapezoidal flap that mates to and is adhered to a trapezoidal flap formed from a longitudinal bend in the sleeve side wall 205, forming a member 210. Sleeve sidewall 206 takes a different form, having a trapezoidal support member 208 formed from 2 bends in the paperboard, after the second bend forming another trapezoidal member 209. This forms a flat bottom that has enough give to accept the deformation of the basket bottom due to the weight of the produce. when assembled.

Figure 12:
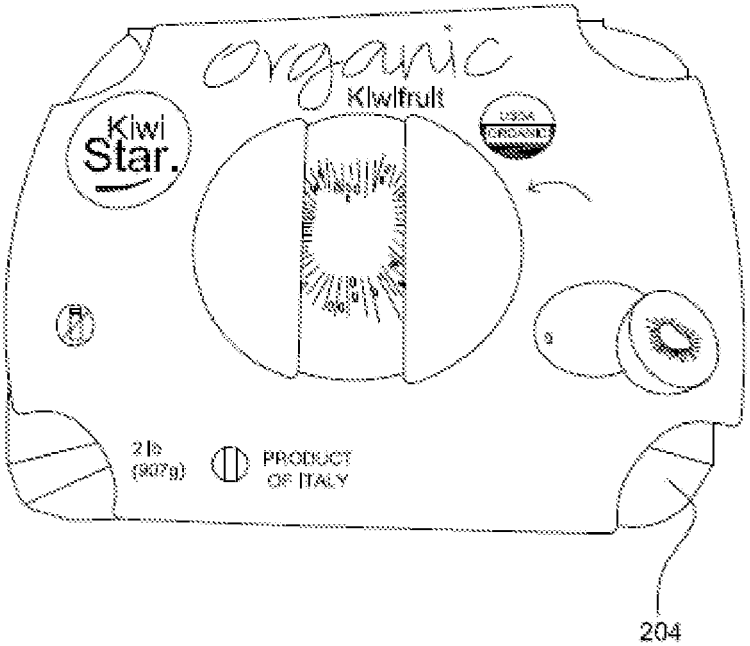
FIG. 12 represents a top view of the assembled carrying sleeve according to an aspect of the present invention.

The corner vents 204 are scooped in shape to increase the vent area along the top of the short end of the basket as shown in FIG. 12.

Figure 13:
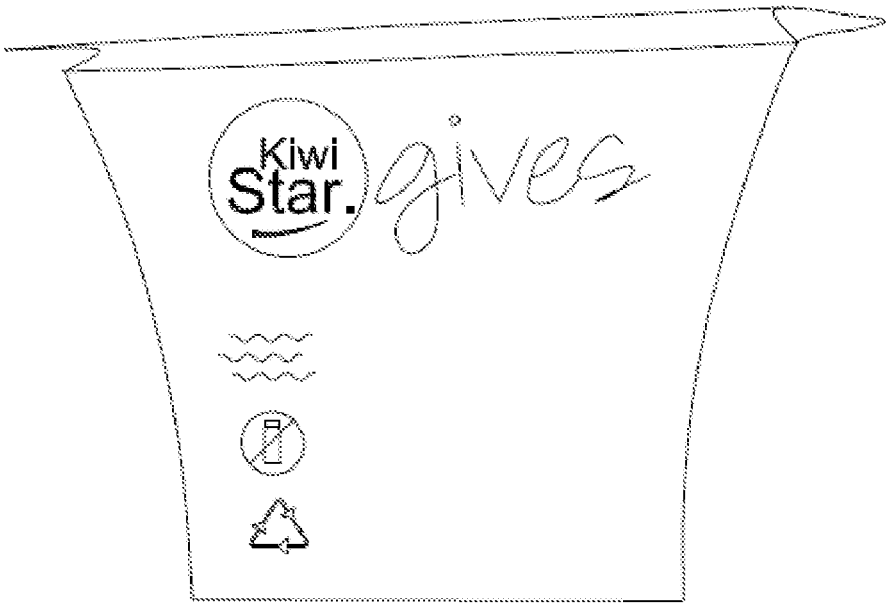
FIG. 13 is a side view of the assembled carrying sleeve according to an aspect of the present invention.

The sleeve side walls 205 and 206, shown in FIG. 13, are curved to provide strength while reducing paperboard used.

Figure 11:
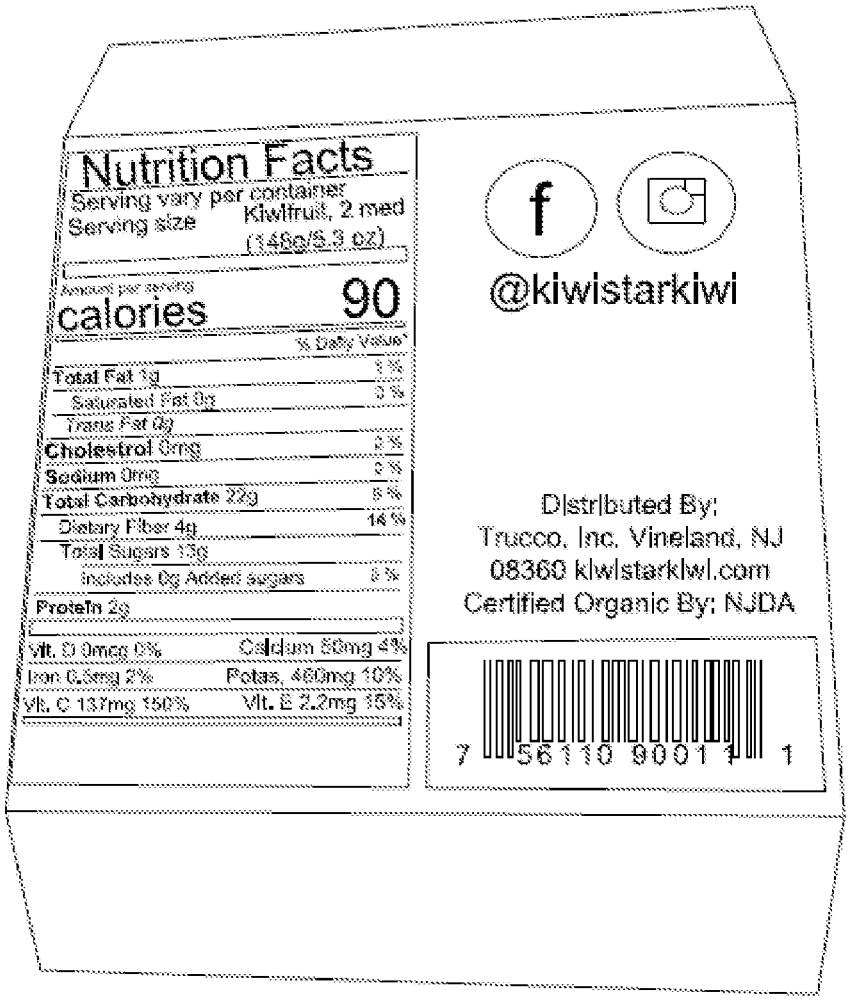
FIG. 11 is a bottom view of an assembled carrying sleeve according to an embodiment of the present invention.

As shown in FIG. 11, the sleeve bottom 207 has on one end a trapezoidal flap that mates to and is adhered to a trapezoidal flap formed from a longitudinal bend in the sleeve side wall 205. Sleeve sidewall 206 takes a different form, having a trapezoidal support member 208 formed from 2 bends in the paperboard, after the second bend forming another trapezoidal member 209. This forms a flat bottom that has enough give to accept the deformation of the basket bottom due to the weight of the produce when assembled.

Figure 14:
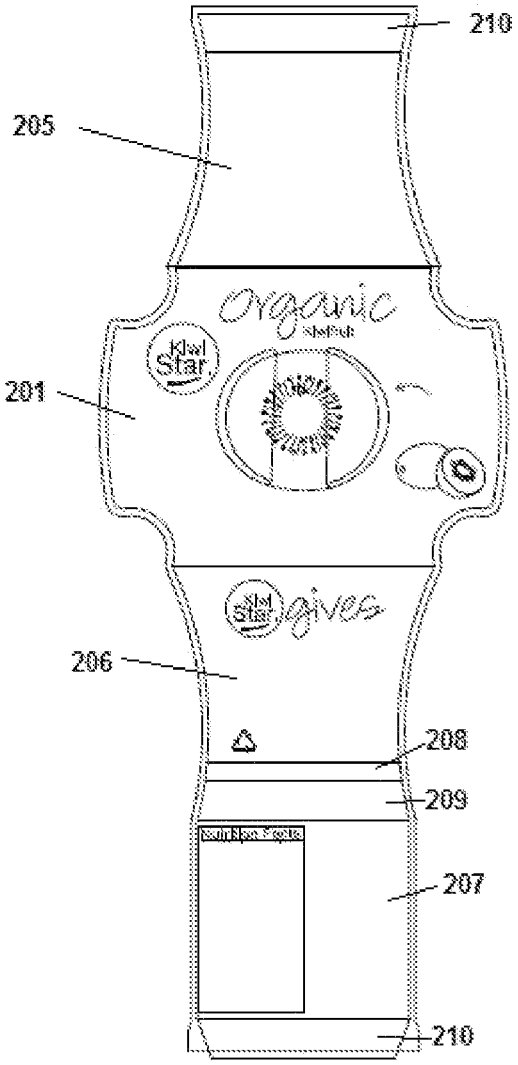
FIG. 14 shows an unassembled carrying sleeve according to an aspect of the present invention.

The unassembled carrying sleeve in the form of pre-perforated pre-cut sheet is shown in FIG. 14. The produce basket with a carrying sleeve assembly/combination is formed by folding a pre-perforated basket sheet and the carrying sleeve is formed by a folding a pre-perforated carrying sleeve sheeve so that the assembled carrying sleeve can be slid over the produce basket as shown in FIG. 15.

Figure 15:
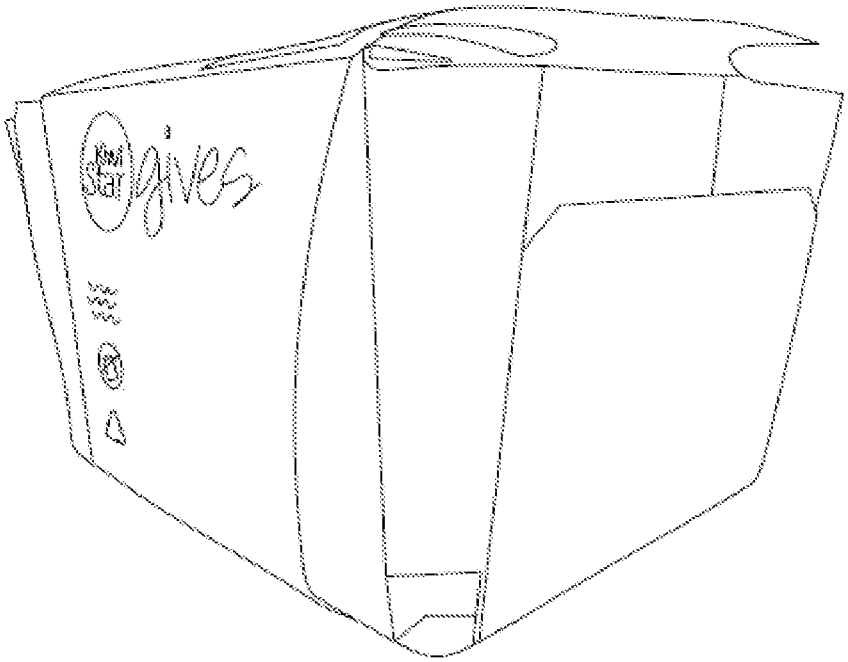
FIG. 15 is a perspective view of the basket and carrying sleeve assembly according to an aspect of the present invention.
Figure 16:
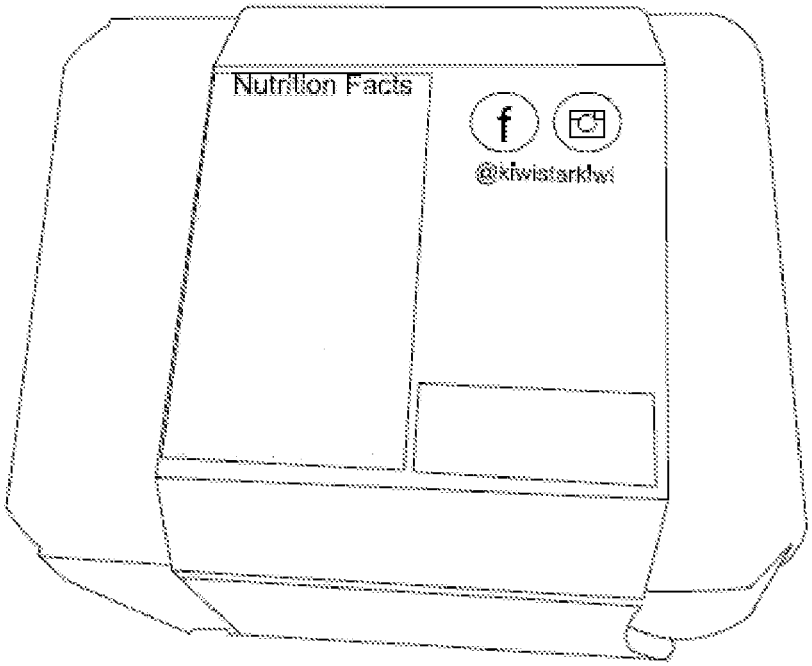
FIG. 16 is a bottom view of the basket and carrying sleeve assembly of FIG. 15.

FIG. 15 is a perspective view of the basket and carrying sleeve assembly according to an aspect of the present invention;

FIG. 16 is a bottom view of the basket and carrying sleeve assembly of FIG. 15. The bottom of the sleeve forms a flat bottom that has enough give to accept the deformation of the basket bottom due to the weight of the produce when assembled.

Figure 17:
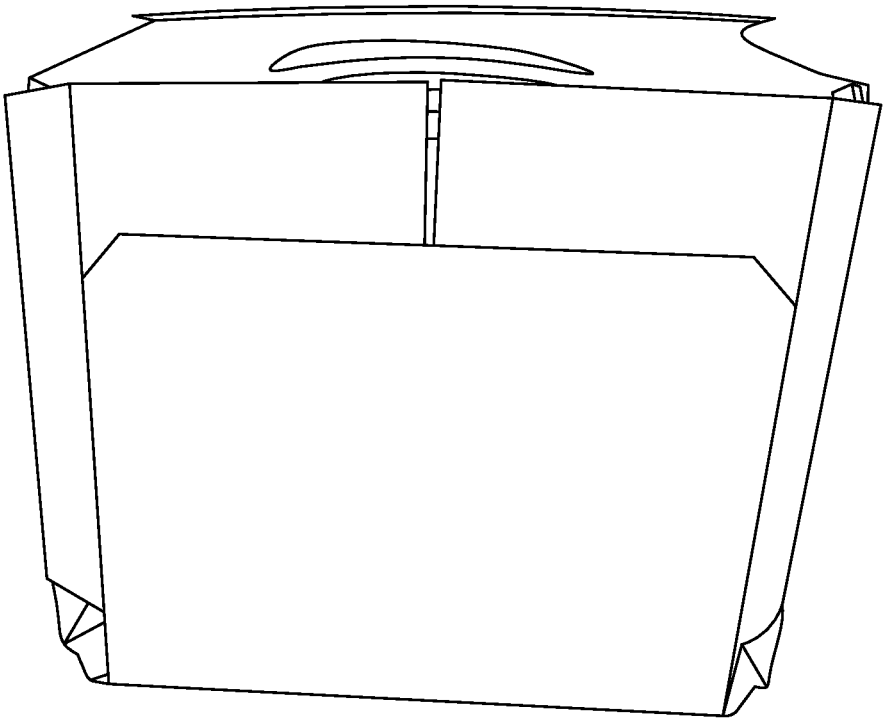
FIG. 17 represents a side view of the basket and carrying sleeve assembly of FIG. 15.

FIG. 17 represents a side view of the basket and carrying sleeve assembly of FIG. 15.

Figure 18:
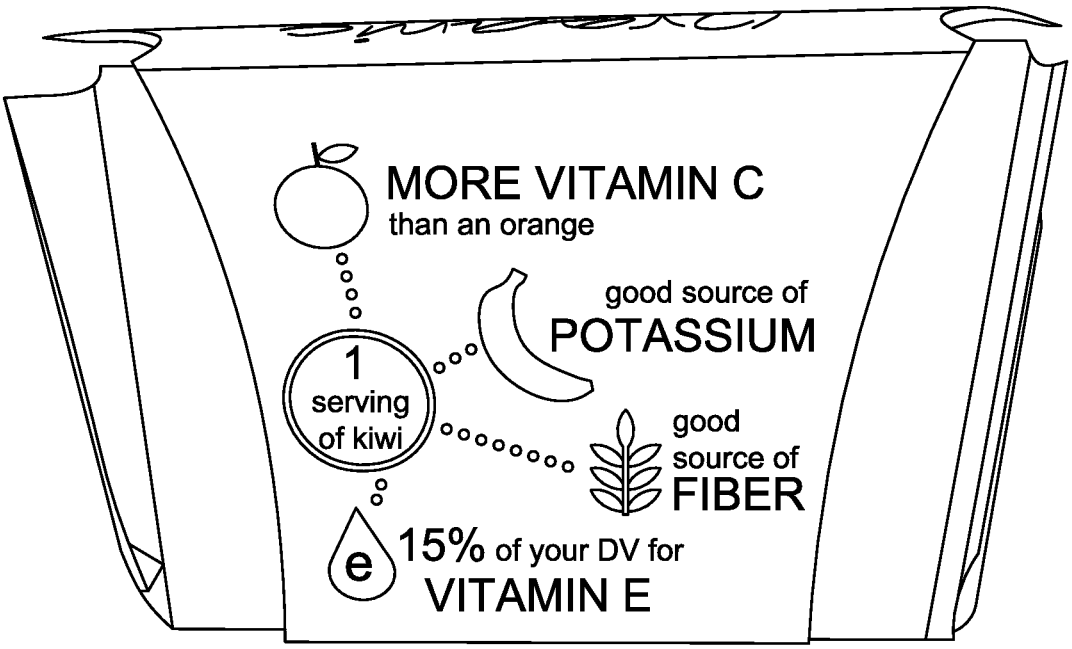
FIG. 18 is a side view of the basket and carrying sleeve assembly depicting a side of the assembly, which is adjacent to the side shown in FIG. 17.

FIG. 18 is a side view of the basket and carrying sleeve assembly depicting a side of the assembly, which is adjacent to the side shown in FIG. 17.

Figure 19:
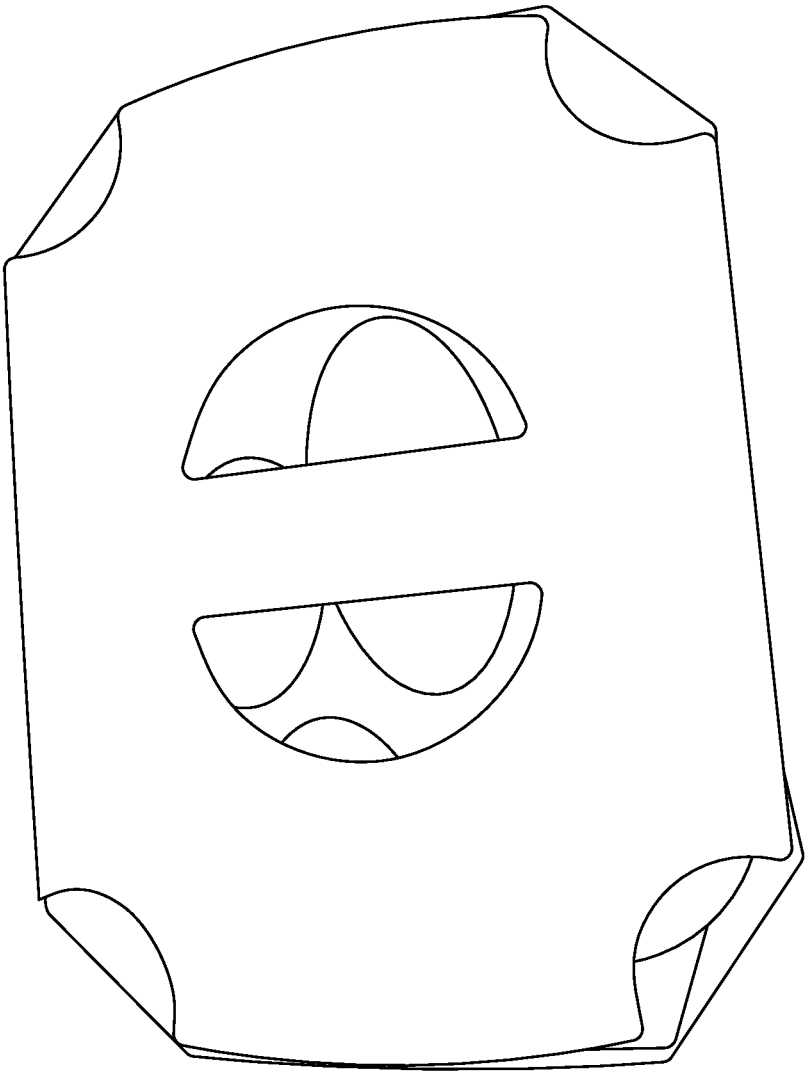
FIG. 19 depicts the basket and carrying sleeve assembly viewed form above in a closed position.
Figure 20:
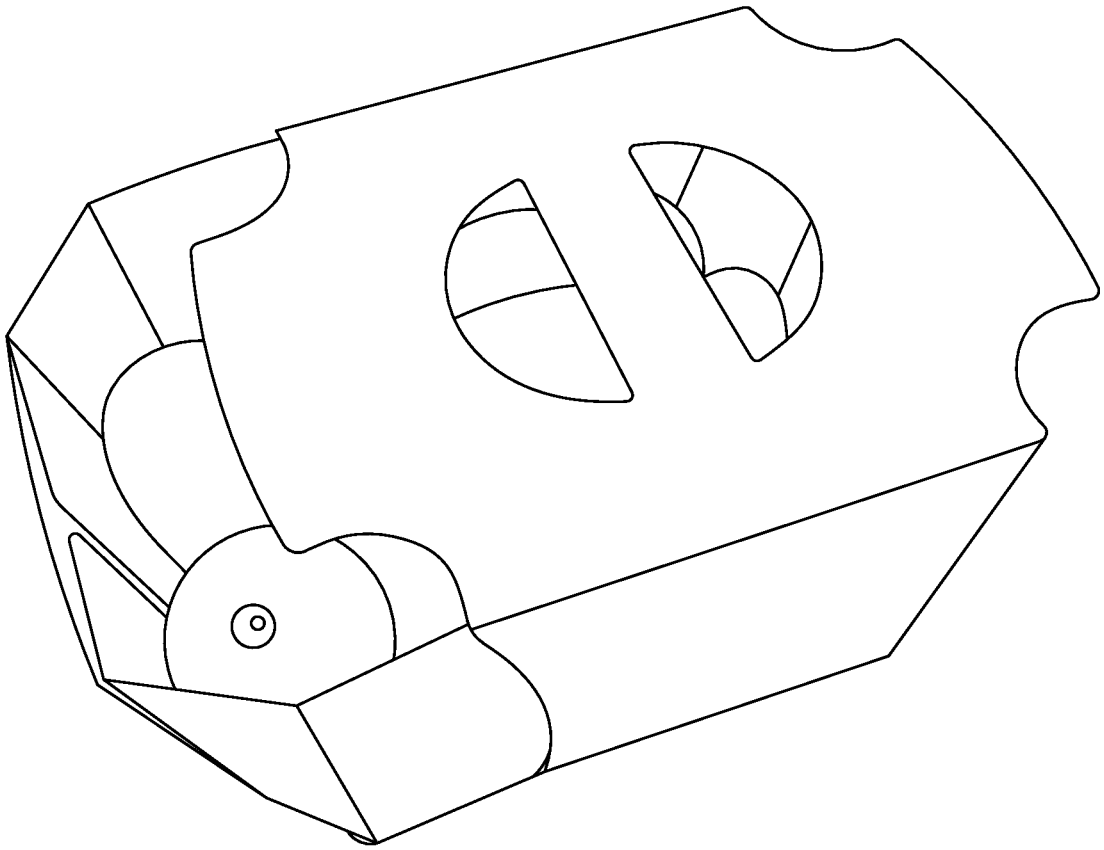
FIG. 20 depicts the basket and carrying sleeve assembly in semi-open position.

FIG. 19 depicts the basket and carrying sleeve assembly viewed form above in a closed position. The sleeve can be slid so that the produce can be easily removed from the basket. FIG. 20 depicts the basket and carrying sleeve assembly in semi-open position.

The foregoing description of the present invention has been presented for the purpose of illustration and description. It is not intended to be exclusive or to limit the invention to the precise form disclosed, and other modifications and variations may be possible in light of the details given above. The embodiment was chosen and described to best explain the principles of the invention and its practical application, thereby enabling others skilled in the art to utilize the invention in various embodiments and various modifications, as suited to the particular use contemplated. It is intended that the appended claims be construed to include other alternative embodiments of the invention except in so far as limited by the prior art.

The invention claimed is:

1. A produce basket with a carrying sleeve comprising:

a paperboard basket having a bottom and four sides; and a paperboard carrying sleeve;

wherein the sleeve has at least four sides one of which is the sleeve top and wherein the sleeve top has an integral handle disposed in the approximate center of the sleeve top;

wherein the carrying sleeve can be slid over the basket with the sleeve top covering the basket top; and wherein the basket is formed by folding a pre-perforated pre-cut basket sheet and the carrying sleeve is formed by a folding a pre-perforated pre-cut carrying sleeve sheet and wherein the basket's four sides are separated by flexible trapezoidal separators each supporting a tab which serves to connect each side to its adjacent side, forming an irregular octagonal and wherein the flexible trapezoidal separators serve to form, with the four sides, a tapered basket, and wherein the carrying sleeve is seven-sided, having a top, a bottom, a first vertical area consisting of 2 panels and a second vertical area consisting of 3 panels.

2. The produce basket of claim 1 wherein the carrying sleeve has:

a support member connecting its bottom side to one of the vertical sides which support member is formed from a bend in the bottom side paperboard wherein said support member allows the carrying sleeve to deform when filled with produce.

* * * * *